US005899639A

United States Patent [19]

Simmons

[11] Patent Number: 5,899,639

[45] Date of Patent: May 4, 1999

[54] OFFSHORE STRUCTURE FOR EXTREME WATER DEPTH

[75] Inventor: John Simmons, Enfield, United Kingdom

[73] Assignee: McDermott International, Inc., New Orleans, La.

[21] Appl. No.: 09/023,452

[22] Filed: Feb. 13, 1998

Related U.S. Application Data

[63] Continuation-in-part of application No. 08/605,402, Feb. 22, 1996, abandoned.

[51] Int. Cl.[6] ..... E02B 17/00

[52] U.S. Cl. ..... 405/227; 405/195.1; 405/202

[58] Field of Search ..... 405/227, 223.1–224.4, 405/195.1, 202, 204, 225, 226

[56] References Cited

U.S. PATENT DOCUMENTS

| | | | |
|---|---|---|---|
| 4,069,683 | 1/1978 | Jansz | 405/227 |
| 4,184,790 | 1/1980 | Bassett | 405/227 X |
| 4,558,973 | 12/1985 | Blandford | 405/227 X |
| 4,684,292 | 8/1987 | Deserts et al. | 405/227 X |
| 4,695,202 | 9/1987 | Aggradi et al. | 405/227 |
| 4,696,604 | 9/1987 | Finn et al. | 405/227 |
| 4,705,430 | 11/1987 | Will | 405/195.1 X |
| 4,721,416 | 1/1988 | Gracia | 405/225 X |
| 4,721,417 | 1/1988 | Piaxza et al. | 405/195.1 X |
| 4,740,107 | 4/1988 | Casbarian et al. | 405/227 X |
| 4,932,811 | 6/1990 | Folding | 405/227 |
| 5,028,171 | 7/1991 | Gray | 405/227 X |

FOREIGN PATENT DOCUMENTS

| | | | |
|---|---|---|---|
| 2193742 | 2/1988 | United Kingdom | 405/227 |

*Primary Examiner*—Dennis L. Taylor
*Attorney, Agent, or Firm*—Robert J. Edwards; D. Neil LaHaye

[57] ABSTRACT

An offshore structure used for the production of or exploration for oil or gas or for some other purpose. The configuration enables the offshore structure to be installed and removed simply and economically. A central tower is wholly or partly supported by piles, foundations, and a template which is located on the sea bed and to which the central tower is attached. The dimensions of the central tower and the location and dimensions of the piles allow the offshore structure to have the desired response characteristics to permit a structurally sound and efficient arrangement. The central tower extends above the water level to support a module, deck, or building, generally referred to as the topsides. The central tower is placed on the template or can be driven into and fixed to the sea bed. The template can be used to drill wells before the installation of the central tower or piles. The arrangement of central tower, piles, template, and foundations permits ease of installation and subsequent removal as each operation can be undertaken with the structure in a secure condition and giving a stable configuration at each stage of the procedure. By using the piles to provide support for the central tower over an extended region of the lower length of the tower, it is possible to reduce the weight of the tower, albeit at the expense of increased pile weight. The reduced weight of the tower assists in easier installation of this component.

17 Claims, 6 Drawing Sheets

OFFSHORE STRUCTURE FOR EXTREME WATER DEPTH

This application is a continuation-in-part of application Ser. No. 08/605,402, filed Feb. 22, 1996, now abandoned.

BACKGROUND OF THE INVENTION

1. Field of the Invention

The invention is related to an offshore structure used for the exploration and production of oil or gas or for some other purpose.

2. General Background

In the offshore drilling industry it is common to use a fixed structure such as a jacket or tower. The jacket or tower is normally held in place by pilings driven into the sea floor through the legs of the structure and possibly also through a template on which the tower is placed. Exploration and development of hydrocarbons and minerals in deeper waters requires taller towers. The larger towers are more expensive to fabricate and require equipment with increased lifting and weight bearing capacity to accommodate the extra weight of the larger towers. The larger towers also have a tendency to present stability problems during installation.

U.S. Pat. No. 4,793,739 teaches a compliant pile system for supporting a concrete structure so that the structure becomes compliant. The fixation of the sleeves is at the lower end at the seabed and the piles can be at the upper portion and the primary function of the pile system is to provide stability and to support it vertically. It is stated that the pile system will increase the sway period. However, the period will be increased only if the stiffness of the concrete structure is reduced. Adding piles will in general increase the overall stiffness of the platform and will decrease the period of oscillation. The concrete structure can be provided with a single rotation shell at the bottom. The piles act to restrain the concrete structure by bending action over the portion above the seabed. The piles provide vertical support.

U.S. Pat. No. 4,721,416 teaches a pile system supported by guides attached to a jacket structure. The fixation of the piles is at the sea bed and at the guides. They are elongated to support the topsides. The piles act as the legs of the structure and the jacket structure only provides the bracing necessary to transfer shear forces between the piles so that the offshore jacket can act in bending. The jacket structure does not support any vertical loading. The piles do not extend above the framing, so that they are not braced over a significant length.

U.S. Pat. No. 4,969,604 teaches a compliant pile assembly for use on a compliant tower system and concerns the use of drive piles and flex piles. The drive piles are driven into the seabed and extend sufficiently to permit a sleeve attached to the side of the flex piles to engage with the drive piles and thereby be attached to them. The flex pile is aligned eccentrically with the corresponding drive pile to which it is attached. To minimize the bending effects, the piles have to be arranged symmetrically about the leg of the tower. The tower supports the topsides but is not provided with a foundation so that the vertical loads are transferred to the flex piles and through the eccentric connection to the drive piles. This also applies to horizontal loads such as environmental forces. The flex piles provide support over a limited portion of the tower and do not directly resist loads from a deck or topsides.

The present art does not teach a structure that permits an efficient distribution of loads between the piles and tower.

This is due to the unsupported tower and the transfer of load from the tower to the piles through an eccentric connection.

SUMMARY OF THE INVENTION

The invention addresses the above deficiencies. What is provided is an offshore structure that can be installed with an offshore installation crane vessel of lesser lifting capability than required by current structures, thus improving the economics of installation and removal, and also can be used in a variety of water depths, but generally greater than about one hundred meters. The offshore structure is formed from a central tower, a plurality of piles, a template, and a foundation. The central tower is placed on the template, which is located on the sea bed and supported by the foundation. The foundation can be piles, spread footings, or suction pad type. The central tower is supported by the template and the piles, which extend to about mid-height of the central tower. The piles are connected at this elevation to the central tower. The piles are generally located below the elevation of the wave affected zone. The dimensions and configuration of the elements of the offshore structure are selected to ensure that the environmental forces are minimized and the motions response and deflections are tolerable. The central tower is narrow and of slender construction to minimize the environmental forces. It is intended to reduce the loads acting on the central tower and template and to transfer them to the piles, which are the main load carrying elements. It is also intended to preferentially transfer the vertical loads to the tension piles without greatly increasing the compression forces in the piles.

Lateral applied loads such as environmental forces induce bending moments in an offshore structure. These forces cause one part of the offshore structure and the adjacent piles to have vertical compression forces and another part of the offshore structure and adjacent piles to have tension forces. The interaction of the piles and tower of the structure act analogously to a reinforced or prestressed beam. The tower will reduce the axial loads in the compression piles, albeit by increasing the loads in the tension piles. The tower is more efficient at resisting compression forces and the piles are more efficient at resisting tension forces.

In the present invention the fixation of the piles is generally at the upper end but can be at any of the sleeves or guides. the piles and central tower acts compositely supporting both vertical loads and horizontal loads. By providing different constraint conditions at the sleeves or guides, it is possible to improve the structural efficiency of both by controlling the relative stiffness of the components and hence the distribution of the loading applied to the structure. This art is not taught elsewhere.

It is possible to further increase the desired distribution of the compression and tension forces in the piles and the tower by selecting the type of sleeve or guide. By using either a fixed, a sliding, or an elastomeric sleeve, a selected range of forces caused by the cyclic action of environmental effects and other loads can be obtained. It is further possible to design the guide or sleeve to act as a stiff support in one direction and a flexible support in the reverse direction so that compression forces in the piles are reduced and tension forces in the piles are resisted.

It is a feature of the invention that the method and sequence of installation can be achieved efficiently and by an economic method. It is also a feature of the invention that the removal of the offshore structure can be carried out by a procedure similar to the installation and that this can also be performed in an efficient and economic manner.

It is an object of the invention to provide an offshore structure that is economic to install. By virtue of the components of the central tower, piles, template, and foundation, and the spatial configuration of the components, the invention is an improvement and has significant advantages compared with conventional offshore structures.

It is also an object of the invention to provide an offshore structure that retains the flexibility of application that permits the use of the offshore structure over a wide range of sites.

It is another object of the invention to allow installation with the use of a crane barge with a relatively modest load lifting capacity since the central tower is designed to have lower weight than a conventional offshore structure.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
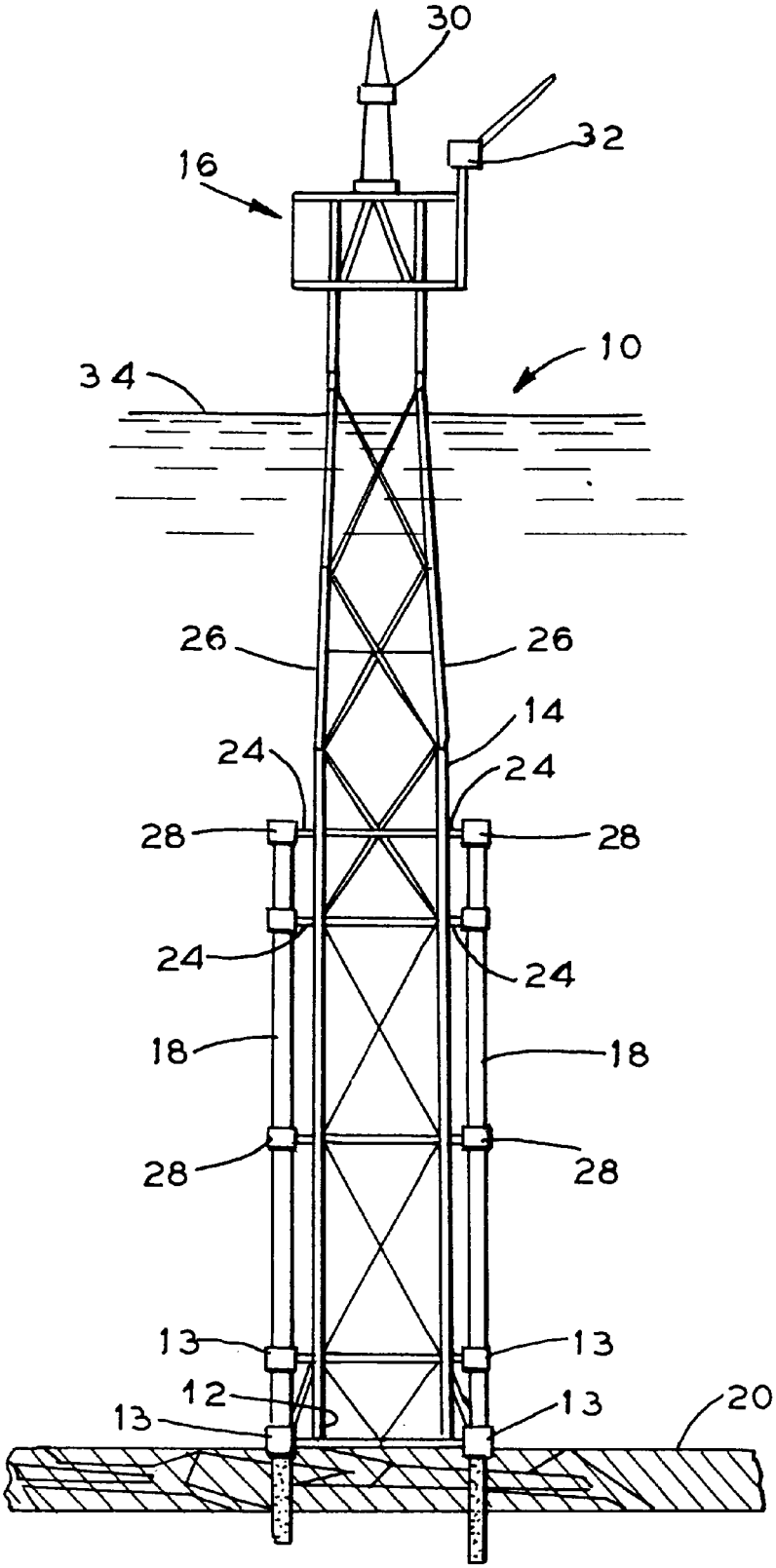
FIG. 1 is an elevation view of the invention.
Figure 6:
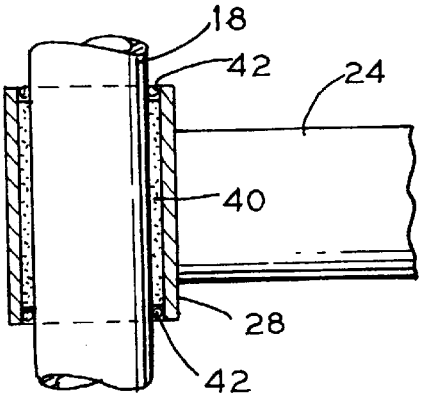
FIGS. 6–8 are sectional views of alternative sleeve or guide arrangements on the cantilever extension from the tower and used as a connection to the piles.
Figure 7:
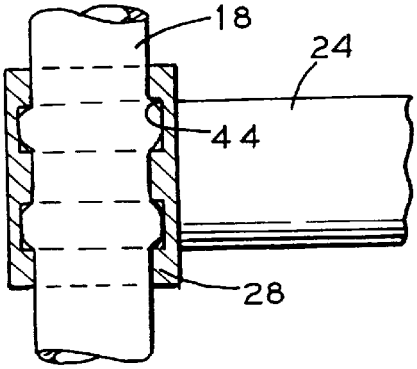
Figure 8:
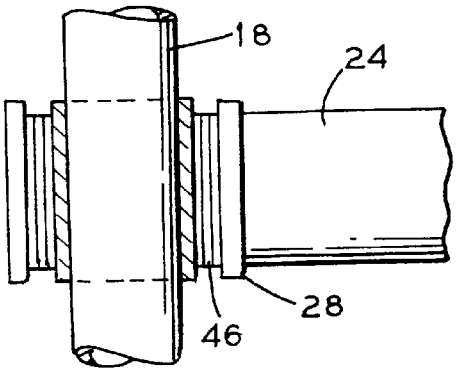

Referring to FIG. 1, there is shown a topsides or deck 16, which is supported by a central tower 14. The central tower 14 supports piping, drilling caissons and conductors, umbilicals or any other services required for the facilities contained in the topsides 16, or to enable the production or drilling for oil, gas or other minerals or for any other activity for which the offshore structure 10 is to be used. The central tower 14 is provided with a plurality of cantilevers 24 at or about mid-height and at the base of the central tower 14 or on the template 12 and at other locations as required. At the ends of the cantilevers 24, there are sleeves or guides 28 through which piles 18 are received. As seen in FIGS. 6–8, the piles 18 can be connected to the guides 28 by swaging, grouting, welding, or by some other means. The central tower 14 is attached to the template 12 by a locking mechanism 22, best seen in FIG. 9 and 10, which is engaged when the central tower 14 is positioned on the template 12. The locking mechanism 22 can be incorporated into part of the foundation 36 or can be an extension of the structure that comprises the template 12. Also, the locking mechanism 22 can be part of the guide 28.

The cantilevers 24 are preferably designed to have geometric and material properties that define the stiffness of the cantilevers 24 and will cause predetermined and preferential distribution of compression and tension forces in the piles 18. The above mentioned properties, being those of tubular or beam elements, are the length, cross-sectional shape which affects area and second moment of area, and elastic modulus. Also, sleeves or guides 28 may have a fixed, free, or elastic response in one or more directions so as to cause a desired range of forces in the piles 18.

In the preferred embodiment of the invention, the offshore structure 10 comprises a central tower which is supported by a plurality of piles 18, a template 12, and foundation 36. The central tower 14 can be composed of framing elements, a single tubular construction, or any other suitable structural configuration and will have cantilevers 24 which will support sleeves or guides 28. The piles 18 can be connected to the central tower 14 at approximately mid height and at the lower end, and alternatively at various other elevations between these locations through the sleeves or guides 28. The bottom of the central tower 14 is connected to the template 12, which can be supported on the foundation 36. The foundation can be piles, spread type, suction pads, or any other suitable form. Alternatively, the central tower 14 can be provided with a foundation by installing the bottom section directly in to the sea bed. The piles 18 can be connected to the template or foundation.

Figure 2:
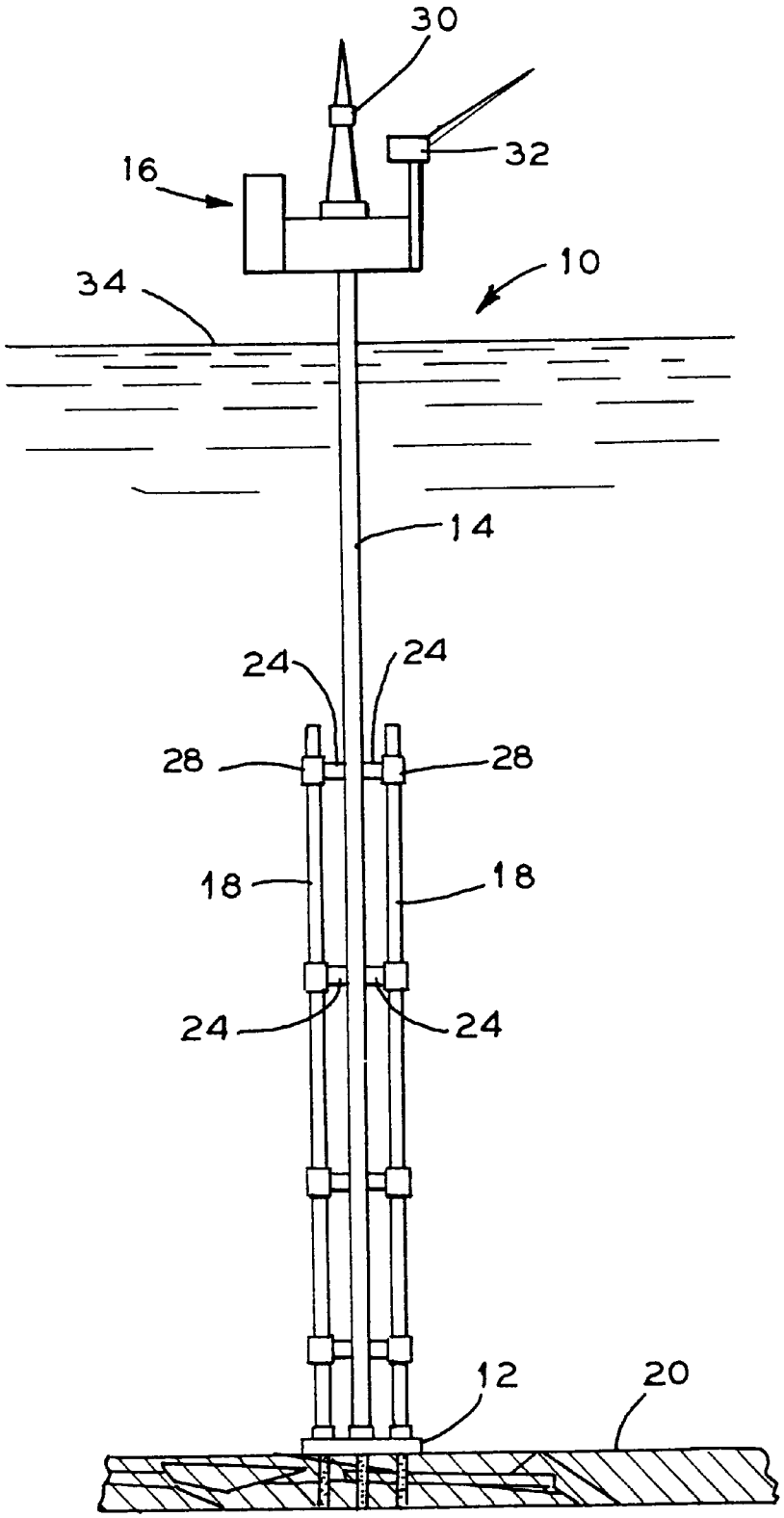
FIG. 2 is an elevation view of the invention wherein a tubular construction is used for the central tower.

Referring to FIG. 2, there is shown an offshore structure similar to that shown in FIG. 1 except that the central tower 14 is shown as might be used for extreme water depth. In this embodiment, the central tower 14 is of tubular construction.

Figure 3:
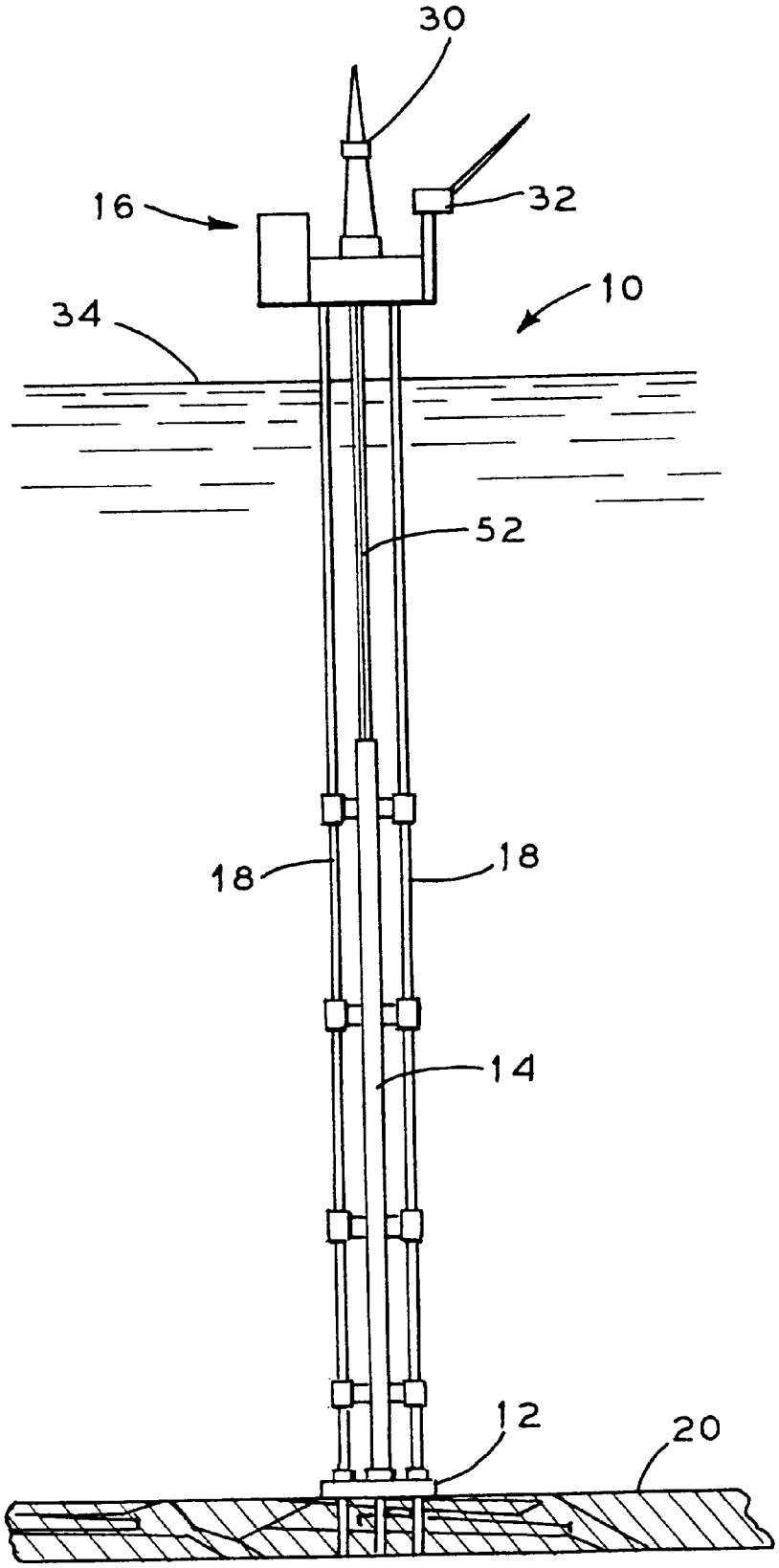
FIG. 3 is an elevation view of an alternate embodiment of the invention where the deck is supported by the piles.

Referring to FIG. 3, there is shown an alternate embodiment of the invention to that shown in FIG. 2, except that the central tower 14 is shown truncated and the piles 18 are shown extended to support the deck 16. The central tower 14 acts as a guide for the installation of the piles 18, to reduce the buckling length of the piles 18, and to transfer a proportion of the force induced by the environmental loading between the various piles and to the template such that composite action between the piles and the tower can be ensured. The height of the central tower 14 extends to about mid height of the piles 18 or to some other elevation generally below that of the wave affected zone. It is not taught elsewhere that the tower height can be reduced to an elevation significantly below the water line and the piles can be extended to support the deck or topsides without bracing over a considerable length. For this embodiment, the dimensions of the piles will provide sufficient buckling capacity to resist the vertical loads applied. The risers, well conductors and other service lines 52 are exposed, which will eliminate the possible accumulation of gas inside the central tower 14, and allow inspection and maintenance.

Figure 4:
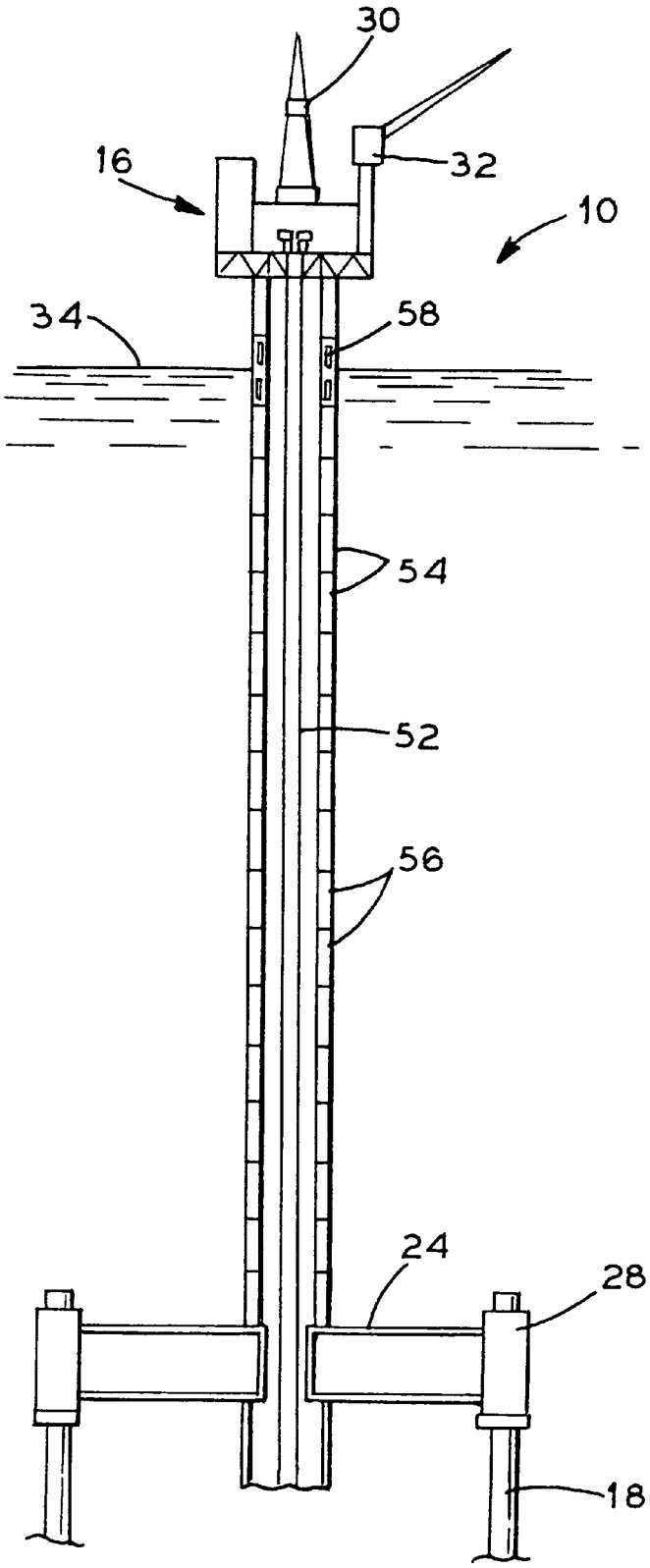
FIG. 4 is a sectional view of the upper portion of the structure shown in FIG. 3.

Referring to FIG. 4, there is shown the sectional view of the upper part of the offshore structure 10 of FIG. 2. The central tower 14 can be provided with ballast tanks 54, and oil storage tanks 56. At the water line, a section of the central tower 14 can be provided with impact protection devices 58.

FIGS. 5A–D show a possible installation procedure for one form of the invention.

Figure 5A:
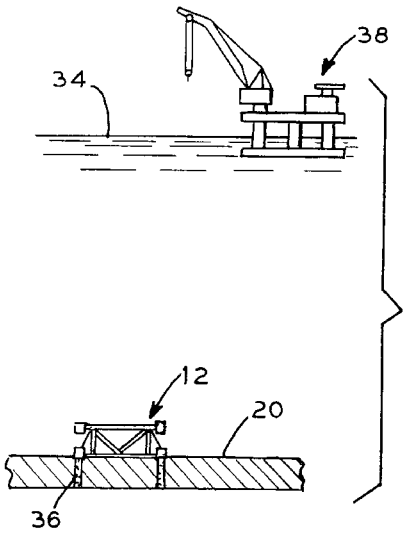
FIG. 5A is a view of the invention during installation with the template on the sea bed.

Referring to FIG. 5A, there is shown the template 12, which has been installed on the sea bed and the foundation 36 installed such that the template 12 is ready to accept the placement of the central tower 14. The locking mechanism 22 is prepared to be in the retracted position to allow the central tower 14 to be in the correct location and in the proper alignment and level before engagement with the template 12.

Figure 5B:
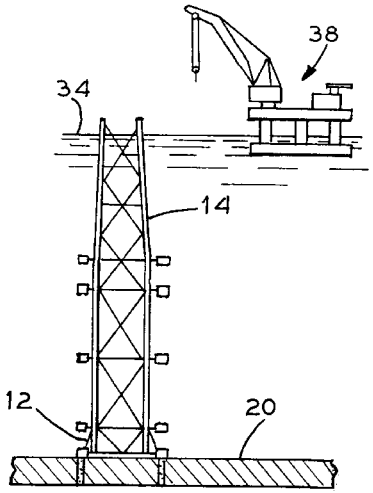
FIG. 5B is a view of the invention with the template and foundations on the sea bed and the tower installed and connected to the template.

Referring to FIG. 5B, there is shown the template 12 with the central tower 14 positioned on the template 12, and the locking mechanism 22 activated to lock the central tower 14 to the template 12.

Figure 5C:
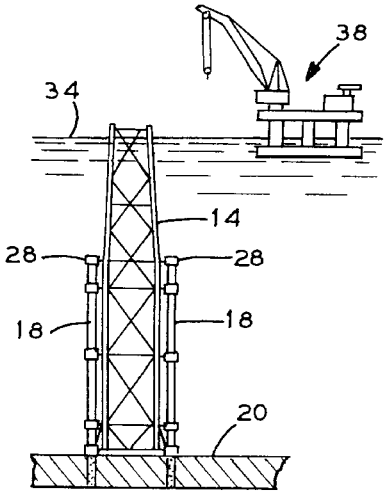
FIG. 5C is a view of the invention with the template and foundations on the sea bed, the tower connected to the template and the piles installed through the guides on the tower and on the template or at the bottom of the tower.

Referring to FIG. 5C, there is shown the template 12 and the central tower 14 with the piles 18 placed through the guides 28 in preparation for attachment to the foundations by grouting, swaging, mechanically or by any other suitable means.

Figure 5D:
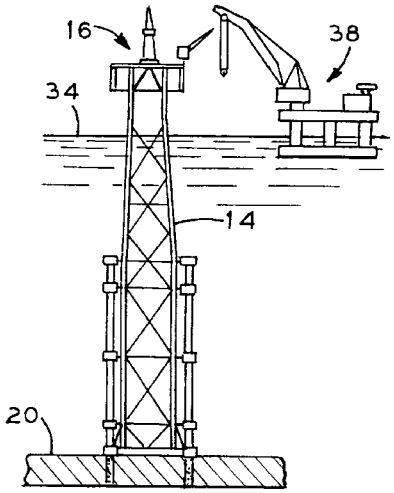
FIG. 5D is a view of the invention with the template and foundations driven into the sea bed and the tower connected to the template and the piles installed through the guides on the tower and template and the piles driven into the sea bed and topsides installed on the tower.

Referring to FIG. 5D, there is shown the template 12, central tower 14, and the piles 18 with the piles 18 installed through the guides 28 and attached to the central tower 14 by grouting, swaging mechanically or by any other suitable means, and the deck 16 placed on the central tower 14.

Referring to FIGS. 6–8, there is shown alternative sleeve or guide arrangements.

FIG. 6 illustrates the use of grouting wherein grout 40 is pumped into the annulus between the inner diameter of the sleeve 28 and the outer diameter of the piling 18. Grout sleeve 42 is placed between the piling and sleeve at the top and bottom of the sleeve.

FIG. 7 illustrates a connection means wherein a portion of the piling 18 is mechanically swaged into recesses 44 that have been machined into the inner surface of the sleeve 28.

FIG. 8 illustrates the use of an elastomeric material 46 positioned between the sleeve 28 and piling 18. The friction provided by the elastomeric material 46 holds the piling 18 in position.

Figure 9:
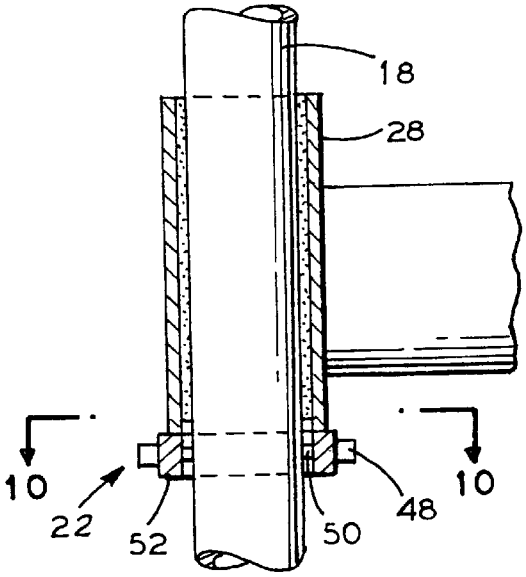
FIG. 9 is a sectional view that illustrates the mechanical connector that may be used between the piling and sleeve or template.
Figure 10:
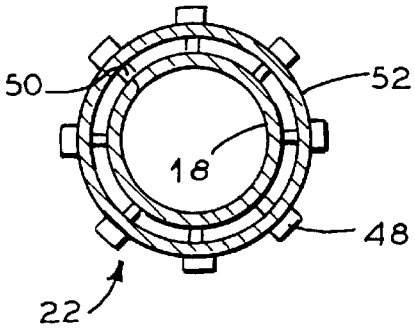
FIG. 10 is a view taken along lines 10—10 in FIG. 9.

Referring to FIG. 9, the locking mechanism 22 is attached to the sleeve or guide 28 and has a plurality of hydraulic rams 48 mounted on the external surface such that the pistons 50 bear against the pile 18 and provide sufficient mechanical restraint to inhibit movement of the pile 18 relative to the sleeve or guide 28.

In an alternate form of the invention not shown, the central tower 14 is either supported by the template 12 as previously described or is placed on to the sea bed such that it becomes self supporting. The piles 18 are installed and provide additional stability and load carrying capability.

In another alternate form of the invention not shown, the central tower 14 is placed directly onto the sea bed and the foundation 36 installed such that the central tower 14 becomes self supporting. Alternatively, the template 12 is installed as previously described and the tower 14 is located over the template and the foundation 36 is installed into the sea bed using the template as a guide.

In another form of the invention not shown, the foundations 36 and template are installed as previously described. The central tower 14 and piles 18 are connected together and installed in one piece. The piles 18 are connected to the foundations and the central tower is connected to the template.

The procedure for removal is as follows. The deck 16 is removed. The riser, conductors, and other services 52 are disengaged. The piles 18 are disconnected from the central tower 14. The piles 18 can be left in this condition or can be disconnected from the foundations 36 and can be separately removed at this stage. The central tower 14 is structurally stable in this condition. The central tower 14 is unlocked or severed from the template 12. The central tower 14, separately or together with the piles, can be removed. The template 12 is disconnected from the foundations 36 and the template 12 can be removed.

The invention provides several advantages over the known art. The template 12 may be used to assist in the installation of the foundation piles prior to the placement of the central tower 14. The template 12 supports the central tower 14 and piles 18. The piles 18 and central tower 14 act compositely and the central tower 14 supports a proportion of the vertical loads. The piles 18 can be attached coaxially with and directly to the foundation piles 36 without eccentricity and therefore do not need to be symmetrically located and can be of any number. By not having on offset between the piles 18 and the foundation piles 36, it is possible to improve upon the efficiency of both and avoid the use of the connection of the sleeve 28 to the pile as the sleeve can be a continuation of the pile 18. The foundation piles 36 do not have to be composed of piles but can be spread gravity, suction pad, or any other suitable type. The piles can be installed separately from the tower 14 and this permits a simpler and more economic procedure.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method for installing an offshore structure on a sea bed, comprising:

a. placing a template on the sea bed, said template having a plurality of sleeves attached thereto around the outer boundary of said template;

b. inserting a foundation into the sea bed through the sleeves on said template and adjacent to said template;

c. attaching a tower to said template, said tower being of a sufficient length to extend above the water surface and having a plurality of cantilevers attached to and spaced apart along the length of and around the outer boundary of said tower, with a sleeve attached to the outer end of each cantilever such that the sleeves are in coaxial alignment with the sleeves on said template;

d. inserting a piling through each of the sleeves on said tower such that each of said pilings are in contact with the foundation and extend upward to a predetermined position adjacent said tower;

e. attaching each of said pilings to the foundation; and f. attaching each of said pilings to its respective uppermost sleeve on the cantilever on said tower, said cantilevers having geometric and material properties which cause preferential distribution of compression and tension forces in said pilings, and said sleeves having a predetermined response in one or more directions so as to cause a desired range of forces in said pilings.

2. The method of claim 1, further comprising attaching each of said pilings to one or more additional sleeves along the length of said tower.

3. The method of claim 1, further comprising providing buoyancy in the upper portion of said tower.

4. A method for installing an offshore structure on a sea bed, comprising:

a. placing a template on the sea bed, said template having a plurality of sleeves attached thereto around the outer boundary of said template;

b. attaching a tower to said template, said tower being of a sufficient length to extend above the water surface and having a plurality of cantilevers attached to and spaced apart along the length of and around the outer boundary of said tower, with a sleeve attached to the outer end of each cantilever such that the sleeves are in coaxial alignment with the sleeves on said template;

c. inserting a piling through each of the sleeves on said tower and driving each of said pilings into the sea bed such that each piling extends upward to a predetermined position adjacent said tower; and d. attaching each of said pilings to its respective uppermost sleeve on the cantilever on said tower, said cantilevers having geometric and material properties which cause preferential distribution of compression and tension forces in said pilings, and said sleeves having a predetermined response in one or more directions so as to cause a desired range of forces in said pilings.

5. The method of claim 4, further comprising attaching each of said pilings to one or more additional sleeves along the length of said tower.

6. The method of claim 4, further comprising driving said tower through the template into the sea bed before the step of inserting and driving pilings into the sea bed.

7. The method of claim 4, further comprising providing buoyancy in the upper portion of said tower.

8. A method for installing an offshore structure on a sea bed, comprising:

a. placing a template on the sea bed, said template having a plurality of sleeves attached thereto around the outer boundary of said template;

b. attaching a tower to said template, said tower being of a length such that it terminates a predetermined distance below the water surface and having a plurality of cantilevers attached to and spaced apart along the length of and around the outer boundary of said tower, with a sleeve attached to the outer end of each cantilever such that the sleeves are in coaxial alignment with the sleeves on said template;

c. inserting a piling through each of the sleeves on said tower and driving each of said pilings into the sea bed, said pilings being of a length such that they extend a predetermined distance above the water level; and d. attaching each of said pilings to its respective uppermost sleeve on the cantilever on said tower, said cantilevers having geometric and material properties which cause preferential distribution of compression and tension forces in said pilings, and said sleeves having a predetermined response in one or more directions so as to cause a desired range of forces in said pilings.

9. The method of claim 8, further comprising attaching each of said pilings to one or more additional sleeves along the length of said tower.

10. The method of claim 8, further comprising driving said tower through the template into the sea bed before the step of inserting and driving pilings into the sea bed.

11. The method of claim 8, further comprising providing buoyancy in the upper portion of said tower.

12. A method for installing an offshore structure on a sea bed, comprising:

a. placing a template on the sea bed, said template having a plurality of sleeves attached thereto around the outer boundary of said template;

b. inserting foundation pilings into the sea bed through and adjacent to said template;

c. attaching a tower to said template, said tower being of a length such that it terminates a predetermined distance below the water surface and having a plurality of cantilevers attached to and spaced apart along the length of and around the outer boundary of said tower, with a sleeve attached to the outer end of each cantilever such that the sleeves are in coaxial alignment with the sleeves on said template;

d. inserting a piling through each of the sleeves on said tower such that each of said pilings are in contact with their respective foundation pilings and extend upward to a predetermined distance above the water surface;

e. attaching each of said pilings to its respective foundation piling; and f. attaching each of said pilings to its respective uppermost sleeve on the cantilever on said tower, said cantilevers having geometric and material properties which cause preferential distribution of compression and tension forces in said pilings, and said sleeves having a predetermined response in one or more directions so as to cause a desired range of forces in said pilings.

13. The method of claim 12, further comprising attaching each of said pilings to one or more additional sleeves along the length of said tower.

14. The method of claim 12, further comprising providing buoyancy in the upper portion of said tower.

15. A method of removing the offshore structure installed according to the method of claim 1, comprising:

a. detaching the pilings from the foundation pilings;

b. disengaging the pilings from the sleeves and removing the pilings; and c. releasing the tower from the template and removing the tower.

16. A method according to claim 15, wherein the step of disengaging the pilings from the sleeves is substituted by disconnection of the sleeves from the cantilevers.

17. A method according to claim 15, further comprising separating the template from the foundation and removing the template.

* * * * *